US009458731B2

(12) United States Patent
Davis, III et al.

(10) Patent No.: US 9,458,731 B2
(45) Date of Patent: Oct. 4, 2016

(54) TURBINE SHROUD COOLING SYSTEM

(71) Applicant: General Electric Company, Schenectady, NY (US)

(72) Inventors: Charles Lewis Davis, III, Simpsonville, SC (US); Terry Howard Strout, Simpsonville, SC (US); Pawel Piotr Kolniak, Mazowsze (PL)

(73) Assignee: General Electric Company, Schenectady, NY (US)

( * ) Notice: Subject to any disclaimer, the term of this patent is extended or adjusted under 35 U.S.C. 154(b) by 844 days.

(21) Appl. No.: 13/798,239

(22) Filed: Mar. 13, 2013

(65) Prior Publication Data

US 2014/0271104 A1 Sep. 18, 2014

(51) Int. Cl.

| | |
|---|---|
| ***F01D 9/02*** | (2006.01) |
| ***F01D 9/04*** | (2006.01) |
| ***F01D 25/14*** | (2006.01) |
| ***F01D 25/24*** | (2006.01) |

(52) U.S. Cl.

CPC ..... *F01D 9/02* (2013.01); *F01D 9/023* (2013.01); *F01D 9/04* (2013.01); *F01D 25/14* (2013.01); *F01D 25/24* (2013.01)

(58) Field of Classification Search

CPC ..... F01D 9/02; F01D 9/023; F01D 9/04; F01D 9/06; F01D 25/12; F01D 25/14; F01D 25/24; F05D 2240/11; F05D 2260/20

USPC ..... 415/1, 115, 116, 173.1–173.3

See application file for complete search history.

(56) References Cited

U.S. PATENT DOCUMENTS

| | | | | |
|---|---|---|---|---|
| 5,281,085 | A * | 1/1994 | Lenahan | F01D 11/24 415/116 |
| 7,117,983 | B2 | 10/2006 | Good et al. | |
| 8,142,138 | B2 | 3/2012 | Heda et al. | |
| 8,152,446 | B2 * | 4/2012 | Zhang | F01D 11/24 415/108 |
| 2005/0093214 | A1 | 5/2005 | Schroder et al. | |
| 2008/0202877 | A1 | 8/2008 | Good et al. | |
| 2009/0053035 | A1 * | 2/2009 | Zhang | F01D 11/24 415/1 |
| 2010/0218506 | A1 | 9/2010 | Nigmatulin et al. | |
| 2010/0232944 | A1 * | 9/2010 | Hatman | F01D 5/186 415/177 |
| 2010/0278631 | A1 | 11/2010 | Heda et al. | |
| 2010/0303612 | A1 | 12/2010 | Bhatnagar et al. | |
| 2012/0000990 | A1 * | 1/2012 | Reynolds | F02M 51/0603 239/102.2 |
| 2012/0093632 | A1 | 4/2012 | Crespo et al. | |
| 2012/0204398 | A1 | 8/2012 | Herbold et al. | |
| 2012/0301291 | A1 | 11/2012 | Spanos et al. | |
| 2013/0074516 | A1 * | 3/2013 | Heward | F01D 15/10 60/786 |

* cited by examiner

*Primary Examiner* — Thomas Denion
*Assistant Examiner* — Mickey France
(74) *Attorney, Agent, or Firm* — Sutherland Asbill & Brennan LLP

(57) ABSTRACT

The present application provides a turbine shroud cooling system for a gas turbine engine. The turbine shroud cooling system may include a number of variable area cooling shrouds with tuning pins and a number of fixed area cooling shrouds with anti-rotation pins. The variable area cooling shrouds may include modulated cooling shrouds. The fixed area shrouds may include non-modulated shrouds.

20 Claims, 3 Drawing Sheets

TURBINE SHROUD COOLING SYSTEM

TECHNICAL FIELD

The present application and the resultant patent relate generally to gas turbine engines and more particularly relate to gas turbine engines having improved systems and methods for modulating gas turbine shroud cooling air in a reliable, efficient, low cost manner, and with reduced maintenance time.

BACKGROUND OF THE INVENTION

Gas turbine engines include a turbine having multiple blades attached to a central rotor. Hot combustion gases from a number of combustors flow through the blades so as to induce the rotor to rotate. Minimizing the volume of the hot combustion gases bypassing the blades may enhance the overall energy transfer from the hot combustion gas flow to the turbine rotor. A turbine shroud therefore may be positioned within a turbine casing so as to reduce the clearance between the turbine blade tips and the casing.

Similarly, the rotating components in the hot gas path and the associated shrouds may experience wear and tear under the elevated temperatures of typical operation. These hot gas path components generally may be cooled by a parasitic flow of cooling fluid from the compressor or elsewhere. The overall efficiency of the gas turbine engine therefore may be increased by both limiting the clearance between the blades and the shrouds and by limiting the flow of cooling fluids to cool the hot gas path components.

There is thus a desire for improved methods and systems of cooling gas turbine shrouds and related components. Preferably such systems and methods may cool the shrouds with reduced variability in the cooling flow and with reduced installation and maintenance costs.

SUMMARY OF THE INVENTION

The present application and the resultant patent thus provide a turbine shroud cooling system for a gas turbine engine. The turbine shroud cooling system may include a number of variable area cooling shrouds with tuning pins and a number of fixed area cooling shrouds with anti-rotation pins.

The present application and the resultant patent further provide a method of cooling a number of shrouds in a gas turbine engine. The method may include the steps of installing a number of variable area shrouds, installing a number of fixed area shrouds, flowing a cooling flow through the variable area shrouds, modulating the cooling flow through the variable area shrouds, and flowing the cooling flow through the fixed area shrouds.

The present application and the resultant patent further provide a gas turbine engine. The gas turbine engine may include a number of variable area modulated cooling shrouds with tuning pins and a number of fixed area non-modulated cooling shrouds with anti-rotation pins.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
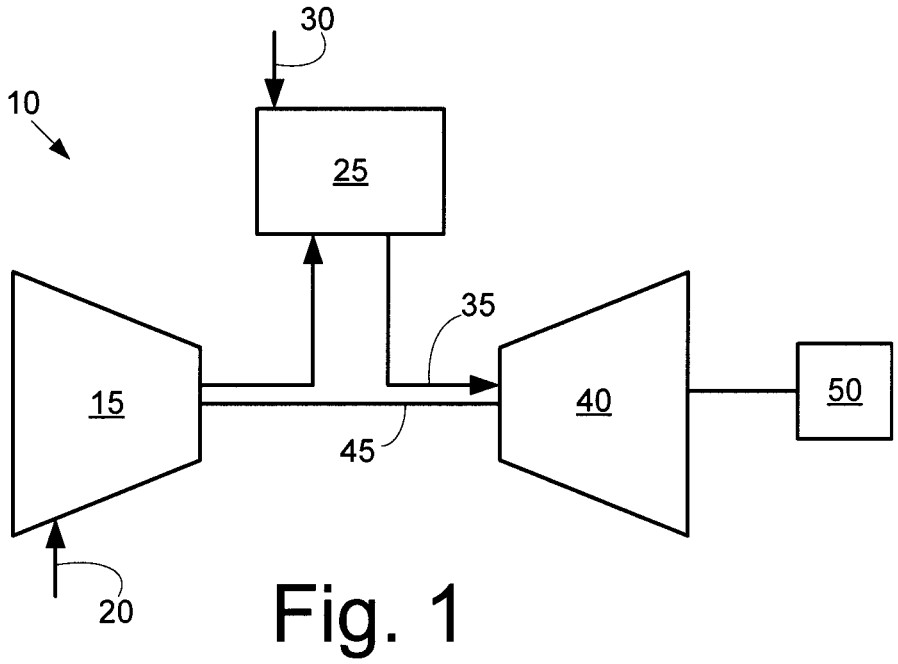
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuels, various types of syngas, and/or other types of fuels and combinations thereof. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
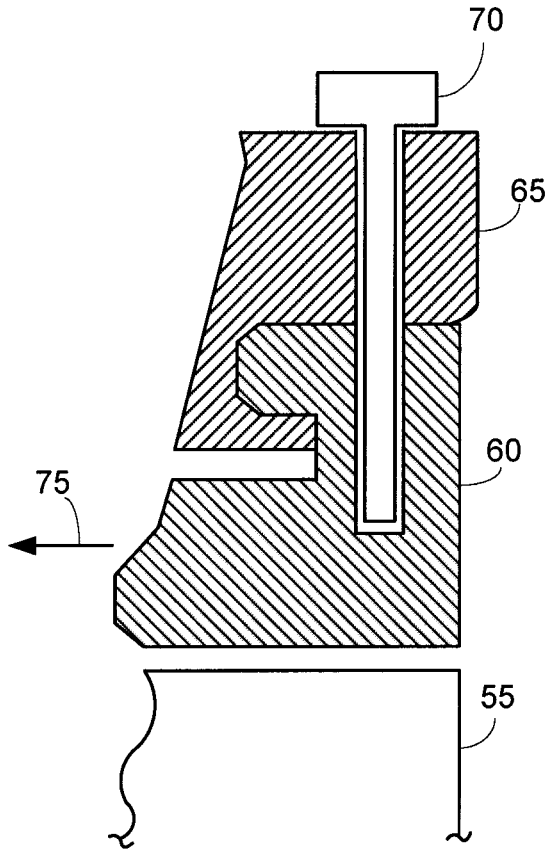
FIG. 2 is a partial side cross-sectional view of a turbine shroud positioned about a casing via a tuning pin.

Generally described, the turbine 40 includes a number of turbine stages. Each stage includes a number of stationary nozzles positioned adjacent to rotating turbine blades or buckets. FIG. 2 shows a portion of a bucket 55. The bucket 55 may be positioned adjacent to a shroud 60. As described above, the use of the shroud 60 may limit the flow of the combustion gas 35 bypassing the bucket 55 and not producing useful work. The shroud 60 may be attached to a casing 65. The shroud 60 may be attached to the casing 65 via a number of pins 70 and the like. The shroud 60 and other components within the hot gas path may be cooled by a flow of cooling air 75 from the compressor 15 or elsewhere. The direction of the flow of cooling air 75 may vary depending upon the overall gas turbine cooling system design. Other types and configurations of turbine stage components may be used herein.

Figure 3:
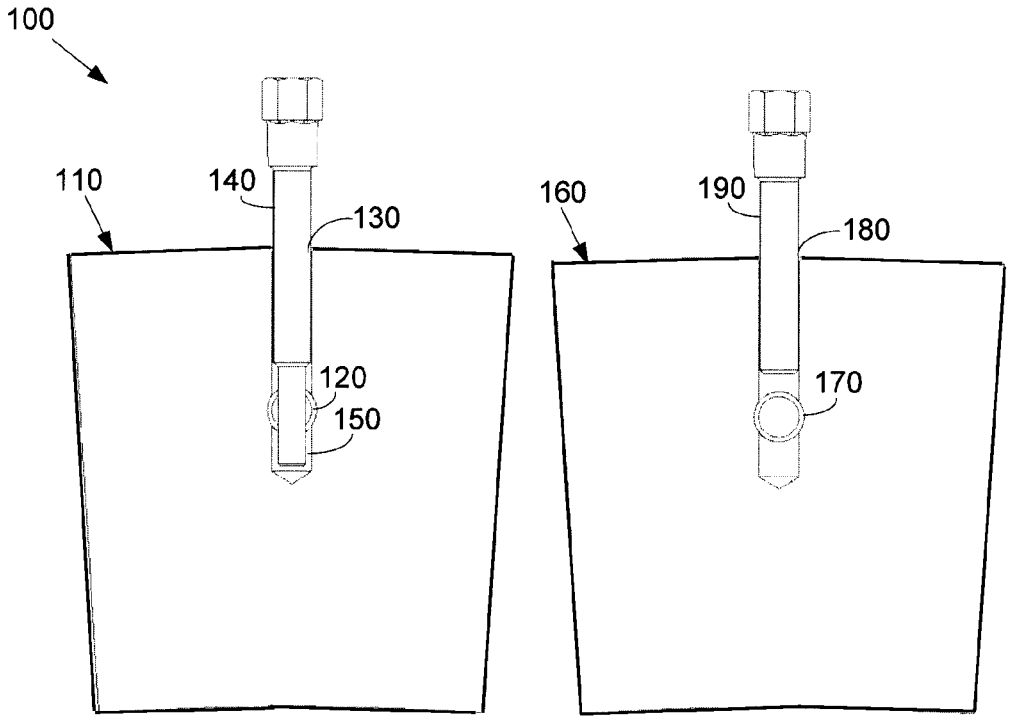
FIG. 3 is a partial axial sectional view of a portion of a turbine shroud cooling system with a variable area modulated shroud and a fixed area non-modulated shroud.

FIG. 3 shows an example of a portion of a turbine shroud cooling system 100 as may be described herein. Similar to that described above, the turbine shroud cooling system 100 may be positioned about the casing 65 and the buckets 55 of the turbine 40 and may be cooled by the flow of cooling air 75. The turbine shroud cooling system 100 may have any size, shape, or configuration.

The turbine shroud cooling system 100 may include a number of variable area modulated shrouds 110. The variable area modulated shrouds 110 may include a variable area cooling hole 120 therein. The variable area cooling hole 120 may be in communication with the flow of cooling air 75 from the compressor 15 or elsewhere. The variable area modulated shroud 110 also may include a pin shaft 130 therein. The pin shaft 130 may intersect the variable area cooling hole 120. The variable area modulated shroud 110 also may include a tuning pin 140. The tuning pin 140 may be positioned within the pin shaft 130. The tuning pin 140 may have a specific end diameter 150. The size of the variable area cooling hole 120, and hence the volume of the cooling air 75 flowing therethrough, may be varied by changing the specific end diameter 150 of the tuning pin 140. A number of variable area cooling holes 120 also may be used. A number of tuning pins 140 with differing specific end diameters 150 thus may available for use herein to modulate the cooling flow 75 as desired. Other components and other configurations may be used herein.

The turbine shroud cooling system 100 also may include a number of fixed area non-modulated shrouds 160. The fixed area non-modulated shrouds 160 may include a fixed area cooling hole 170. The fixed area cooling hole 170 may be in communication with the flow of cooling air 75 from the compressor 15 or elsewhere. A number of fixed area cooling holes 170 may be used. The fixed area non-modulated shroud 160 may include a short pin shaft 180. The short pin shaft 180 need not extend all the way to the fixed area cooling hole 170. The fixed area non-modulated shroud 160 may include an anti-rotation pin 190. The anti-rotation pin 190 may be positioned within the short pin shaft 180. Given the use of the short pin shaft 180, the anti-rotation pin 190 may not be as long as the tuning pin 140. Specifically, the anti-rotation pin 190 thus may lack the specific end diameter portion of the tuning pin 140. Although not required, the anti-rotation pins 190 may be of substantially uniform size and shape. The anti-rotation pins 190 may include a substantially constant diameter along the length thereof. Other components and other configurations may be used herein.

Figure 4:
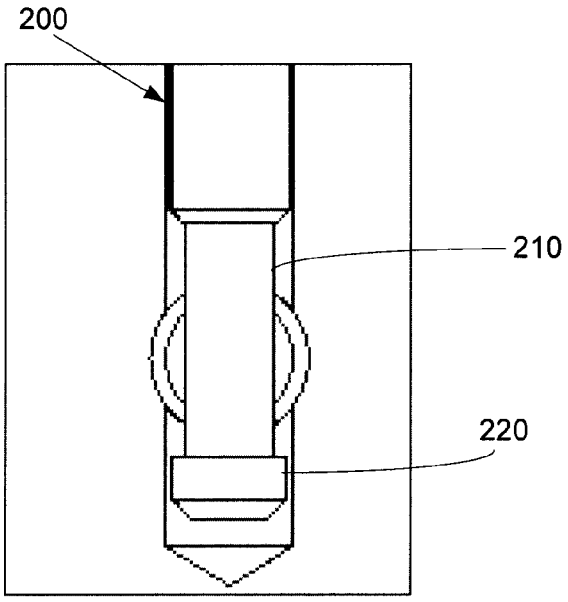
FIG. 4 is a partial axial sectional view of the variable area modulated shroud of FIG. 3 with a tuning pin having a controlled end diameter.

FIG. 4 shows an alternative embodiment of a tuning pin 200 as may be described herein. In this example, the tuning pin 200 may include a specific end diameter 210 similar to that described above but further may include a controlled enlarged end diameter 220. The controlled enlarged end diameter 220 may further block the flow of cooling air 75 therethrough. The size, shape, and configuration of the tuning pin 200 with the controlled enlarged end diameter 220 may vary.

Figure 5:
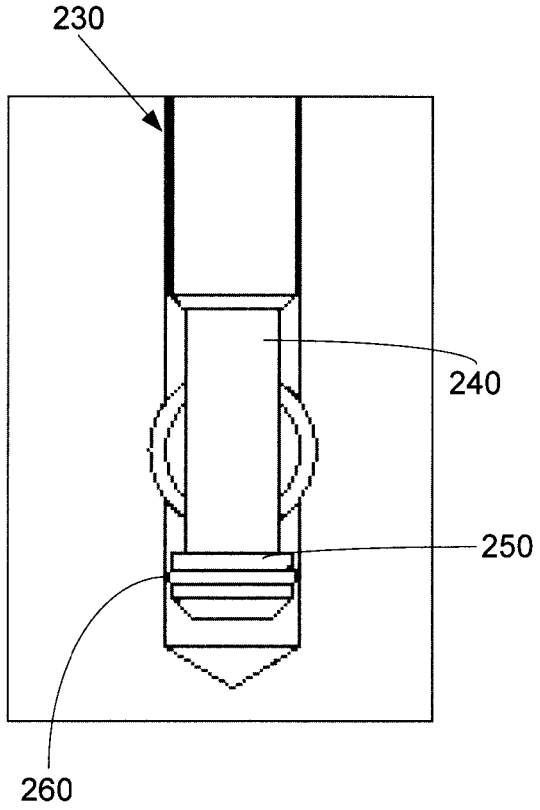
FIG. 5 is a partial axial sectional view of an alternative embodiment of the tuning pin with a controlled end diameter.

FIG. 5 shows a further embodiment of a tuning pin 230. The tuning pin 230 also may include a specific end diameter 240 and a controlled enlarged end diameter 250 similar to that described above. In this example, one or more sealing elements 260 may be added to the controlled enlarged end diameter 250. The sealing elements 260 may be a piston seal, a C-seal, a U-seal, and the like to provide enhanced control of the flow of cooling air 75 therethrough. Other types of sealing elements 260 and the like also may be used herein.

Figure 6:
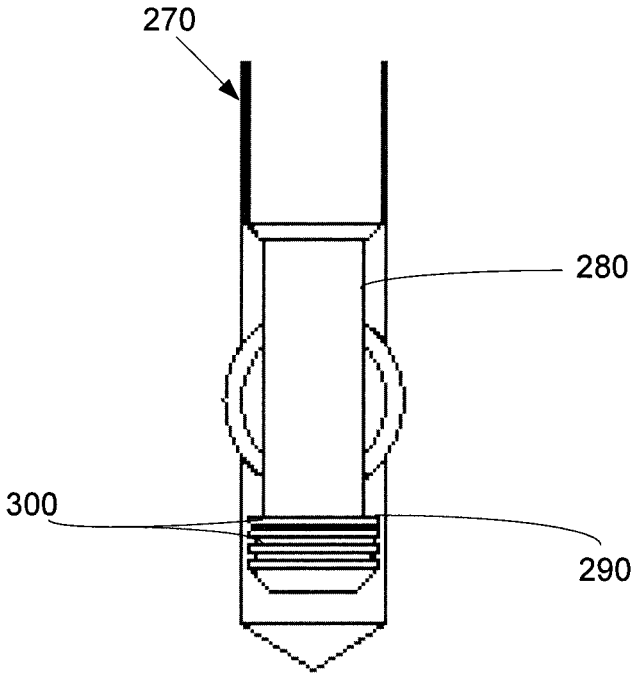
FIG. 6 is a partial axial sectional view of an alternative embodiment of the tuning pin with a controlled end diameter.

FIG. 6 shows a further embodiment of a tuning pin 270. The tuning pin 270 also may include the specific end diameter 280 as well as a controlled enlarged end diameter 290 similar to that described above. In this example, the controlled enlarged end diameter 290 may include a number of sealing grooves 300 formed therein. The sealing grooves 300 also serve to provide enhanced control of the flow of cooling air 75 therethrough. The sealing elements 260 also may be used herein.

In use, the turbine shroud cooling system 100 may include a number of variable area modulated shrouds 110 and a number of fixed area non-modulated shrouds 160. The number of variable area modulated shrouds 110 and the number of fixed area non-modulated shrouds 160 thus may vary. By reducing the number of variable area modulated shrouds 110 as compared to the fixed area non-modulated shrouds 160, the turbine shroud cooling system 100 may reduce flow variability associated with part tolerance variations, shroud machining time and costs due to the reduced hole depth of the short pin shaft 180, the outage cycle time and costs typically required to modulate the variable area cooling holes 120 via the tuning pins 140 of differing end diameters 150, and the total number of different tuning pins 140 generally required. Moreover, using the tuning pins 200, 230, 270 with the controlled enlarged end diameters 220, 250, 290 may reduce the overall bypass flow therethrough. Other components and other configurations also may be used herein.

The turbine shroud cooling system 100 thus reduces the number of cooling air modulation locations, reduces flow variability, reduces the bypass flow around the pins, reduces manufacturing costs and time by reducing hole depth, reduces outage time and costs, and reduces the required pin inventory. The turbine shroud cooling system 100 may be applied to both new and existing gas turbines.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine shroud cooling system for a gas turbine engine having a cooling fluid, comprising:

a plurality of variable area cooling shrouds, wherein a flow rate of the cooling fluid through the plurality of variable area cooling shrouds is variable;

the plurality of variable area cooling shrouds comprising a tuning pin and a variable area cooling hole, wherein the tuning pin has a first length and comprises a pin shaft that intersects the variable area cooling hole, the tuning pin configured to regulate an amount of airflow through the variable area cooling hole; and a plurality of fixed area cooling shrouds having a fixed flow rate of the cooling fluid through the plurality of fixed area cooling shrouds;

the plurality of fixed area cooling shrouds comprising an anti-rotation pin having a second length.

2. The turbine shroud cooling system of claim 1, wherein the plurality of variable area cooling shrouds comprises one or more variable area cooling holes.

3. The turbine shroud cooling system of claim 1, wherein the tuning pin comprises a specific end diameter.

4. The turbine shroud cooling system of claim 3, further comprising a plurality of tuning pins with a plurality of specific end diameters.

5. The turbine shroud cooling system of claim 1, wherein the tuning pin comprises an enlarged end diameter.

6. The turbine shroud cooling system of claim 5, wherein the enlarged end diameter comprises a sealing element.

7. The turbine shroud cooling system of claim 5, wherein the enlarged end diameter comprises one or more sealing grooves.

8. The turbine shroud cooling system of claim 1, wherein the plurality of fixed area shrouds comprises a non-modulated shroud with a fixed area cooling hole.

9. The turbine shroud cooling system of claim 1, wherein the plurality of fixed area shrouds comprises one or more fixed area cooling holes.

10. The turbine shroud cooling system of claim 1, wherein the plurality of fixed area shrouds comprises a short pin shaft.

11. The turbine shroud cooling system of claim 1, wherein the plurality of anti-rotation pins comprises a constant diameter.

12. The turbine shroud cooling system of claim 1, wherein the plurality of variable area cooling shrouds comprise a first number of shrouds, wherein the plurality of fixed area cooling shrouds comprise a second number of shrouds, and wherein the first number of shrouds is less than the second number of shrouds.

13. A method of cooling a plurality of shrouds in a gas turbine engine having a cooling fluid, comprising:

installing a plurality of variable area shrouds, wherein a flow rate of the cooling fluid through the plurality of variable area cooling shrouds is variable;

installing a plurality of fixed area shrouds having a fixed flow rate of the cooling fluid through the plurality of fixed area cooling shrouds;

flowing a cooling flow through the plurality of variable area shrouds;

modulating the cooling flow through the plurality of variable area shrouds by adjusting an end diameter of a tuning pin; and flowing the cooling flow through the plurality of fixed area shrouds.

14. A gas turbine engine having a cooling fluid, comprising:

a plurality of variable area modulated cooling shrouds, wherein a flow rate of the cooling fluid through the plurality of variable area cooling shrouds is variable;

the plurality of variable area modulated cooling shrouds comprising a tuning pin and a variable area cooling hole, wherein the tuning pin has a first length and comprises a pin shaft that intersects the variable area cooling hole, the tuning pin configured to regulate an amount of airflow through the variable area cooling hole; and a plurality of fixed area non-modulated cooling shrouds having a fixed flow rate of the cooling fluid through the plurality of fixed area cooling shrouds;

the plurality of fixed area non-modulated cooling shrouds comprising an anti-rotation pin having a second length.

15. The gas turbine engine of claim 14, wherein the tuning pin comprises a specific end diameter.

16. The gas turbine engine of claim 14, further comprising a plurality of tuning pins with a plurality of specific end diameters.

17. The gas turbine engine of claim 14, wherein the tuning pin comprises an enlarged end diameter.

18. The gas turbine engine of claim 17, wherein the enlarged end diameter comprises a sealing element and/or one or more sealing grooves.

19. The turbine shroud cooling system of claim 1, wherein the second length is less than the first length.

20. The turbine shroud cooling system of claim 5, wherein the enlarged end diameter is positioned to block a flow of the cooling fluid through the variable area cooling hole.

* * * * *